United States Patent [19]

Hubschmitt

[11] 3,945,878

[45] Mar. 23, 1976

[54] STAMP APPLYING MACHINE

[75] Inventor: Richard W. Hubschmitt, Warren, N.J.

[73] Assignee: Schneider Tool and Manufacturing Co., West Orange, N.J.

[22] Filed: Aug. 16, 1974

[21] Appl. No.: 498,038

[52] U.S. Cl. ..... 156/539; 156/566; 156/572; 156/DIG. 31; 156/DIG. 35

[51] Int. Cl.[2] ..... B65C 9/14; B65C 9/20

[58] Field of Search ..... 156/566, 569, 572, 442, 156/442.2, 442.3, 556, 557, 578, DIG. 19, DIG. 31, DIG. 35, 539; 93/73

[56] References Cited

UNITED STATES PATENTS

| | | | |
|---|---|---|---|
| 1,440,856 | 1/1923 | Westcott | 156/DIG. 31 |
| 2,215,085 | 9/1940 | Schnitchen | 156/569 |
| 2,253,923 | 8/1941 | Von Hofe | 156/566 |
| 3,479,986 | 11/1969 | Hoover | 156/578 |
| 3,751,321 | 8/1973 | Hagemann et al. | 156/572 X |

*Primary Examiner*—William A. Powell
*Assistant Examiner*—M. G. Wityshyn

[57] ABSTRACT

A machine for automatically applying stamps onto successive envelopes at a precise location and without distorting or marring the stamps or envelopes comprises vacuum devices for picking off the stamps and envelopes from respective magazines, feeding each envelope into an exact position below a backing pad, and concurrently feeding a respective stamp past a moistening device into an exact position below the envelope, then pressing the envelope against the backing pad and concurrently pressing the stamp upwardly against the envelope, and thereupon releasing the vacuum devices and knocking out the stamped envelope into a receptacle as the machine is returned to a start position for another application cycle.

8 Claims, 13 Drawing Figures

RAISING & LOWERING CAM

STAMP PAD ADVANCE & RETRACT CAM

ENVELOPE ADVANCE & RETRACT CAM

STAMP APPLYING MACHINE

Essential features of stamped envelopes reserved as collectors' items — known as First Day Covers — are that neither the stamps nor the envelopes be blemished or wrinkled in any way as the stamps are applied, and that each stamp be applied in an exact location on each envelope. Further, in the further development of the collecting art, there have been greater runs of First Day Covers put out by governmental and historical agencies, creating the need for machines which can apply stamps automatically in a uniform manner and with greater economy.

Objects of the invention are to provide an automatic machine for applying stamps to cards or envelopes, which is operative to apply the stamps uniformly in the same location throughout long runs and without marring in any way the quality of the stamps and cards or envelopes, and which is operative to apply the stamps in a rapid and economical manner with only minimum required supervision.

These and other objects and features of the invention will be apparent from the following description and the appended claims.

In the description of the invention, reference is had to the accompanying drawings, of which:

Figure 1:
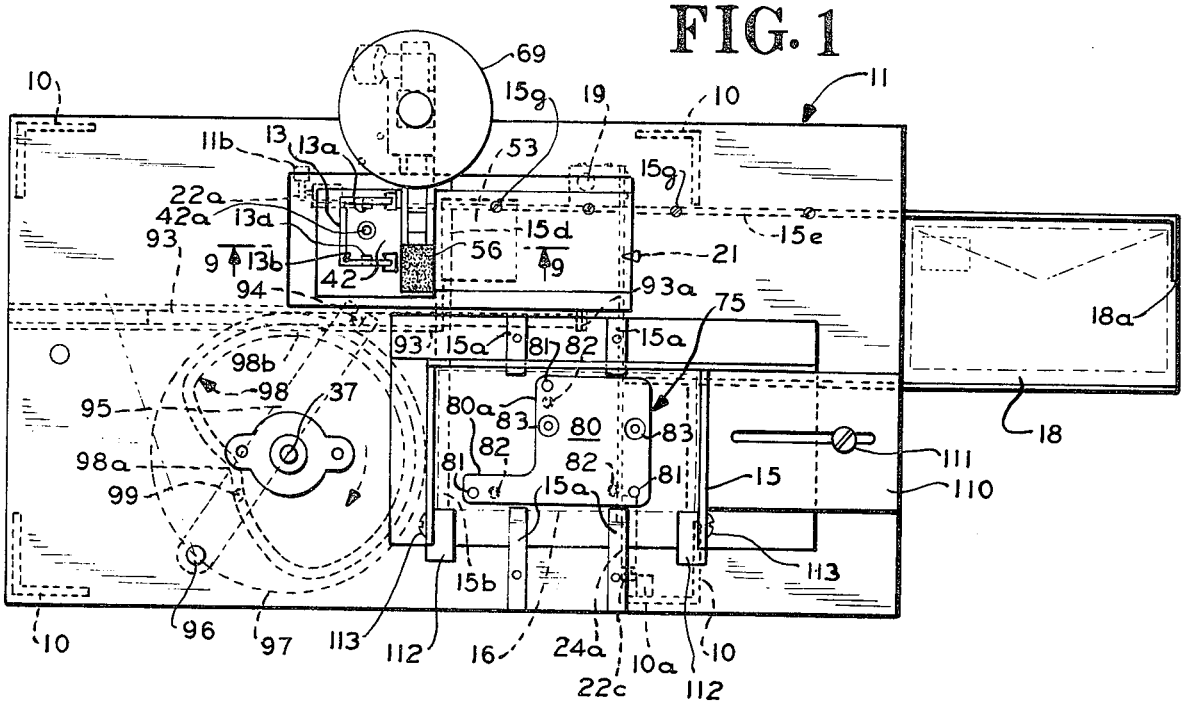
FIG. 1 is a top plan view of an automatic stamp-applying machine according to the invention.

The present machine has four angle iron legs 10 (FIGS. 1 and 2) supporting a top table 11 and a lower shelf 12. Mounted on the table 11 at the back lefthand portion thereof is a magazine 13 for a stack of stamps 14 having corner clearance slots 13*b*, and mounted on the table at the front right-half portion thereof is a magazine 15 for a stack of envelopes 16. The envelope magazine has left and rear walls fixedly mounted on the table top 11, but to permit the magazine to accept envelopes of different sizes the right wall is shiftable by being mounted on a slide plate 110 adjustably secured to the table 11 by a screw-slot coupling 111 and the front corner portions of the magazine are closed by upright posts 112 shiftable back-to-front and adjustably secured to the left and right walls by screw-slot couplings 113 shown in FIG. 11. At the bottom of the magazines 13 and 15 there are inwardly projecting retainer lugs 13*a* and 15*a* which hold the stamps and envelopes releasably in the respective magazines while allowing the same to be drawn off one by one by vacuum devices later described. The table 11 has an overhang 11*a* at the right side thereof which carries therebelow a chute 17 leading into a receptacle 18 for receiving the stamped envelopes. The receptacle extends beyond the overhang and has an opening at the top and a slot 18*a* at the end (FIG. 1) to permit the operator to reach in and remove stacks of the stamped envelopes as they accumulate therein.

Figure 2:
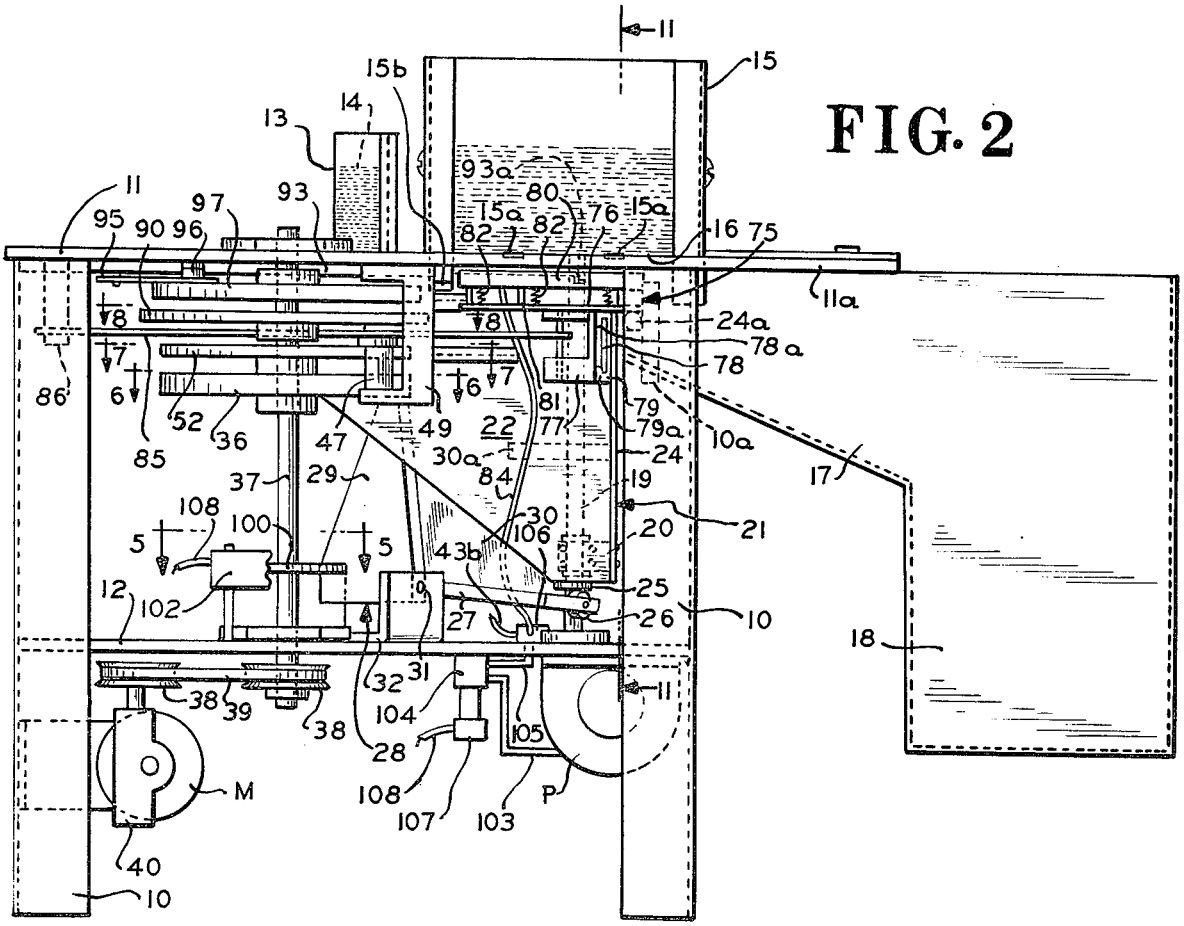
FIG. 2 is a front elevational view of this machine.
Figure 11:
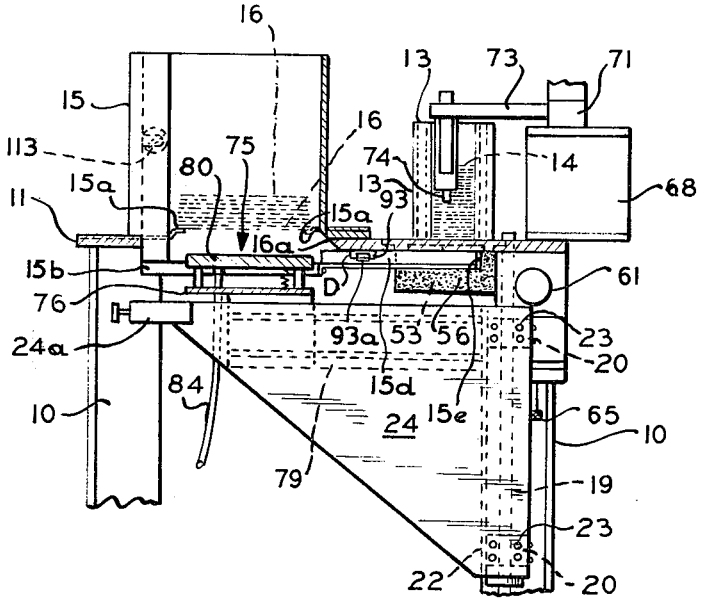
FIG. 11 is a vertical sectional view on the line 11—11 of FIG. 2.

Bridging the table 11 and bottom shelf 12 at the rear righthand portion thereof (FIGS. 1, 2 and 3) is a vertical rod 19 receiving two vertically spaced slide bearings 20 of a main carriage 21. This carriage comprises a rear V-shaped side plate 22 to the back side of which are secured the bearings 20 by screws 23, and a right V-shaped side plate 24 also secured by screws to the bearings. The two side plates 22 and 24 are inclined upwardly from the lowermost bearing 20 along the back and right sides of the machine as is shown in FIGS. 2 and 11. The main carriage 21 is confined against clockwise turning as viewed from the top about the rod 19 by a guide roller 22*a* (FIGS. 3 and 8) on the rear side plate 22 riding against a post 11*b* depending from the table 11, and is confined against counterclockwise movement by a guide roller 24*a* (FIGS. 2 and 8) on the side plate 24 riding against a guide rail 10*a* on the front right leg of the machine.

Figure 3:
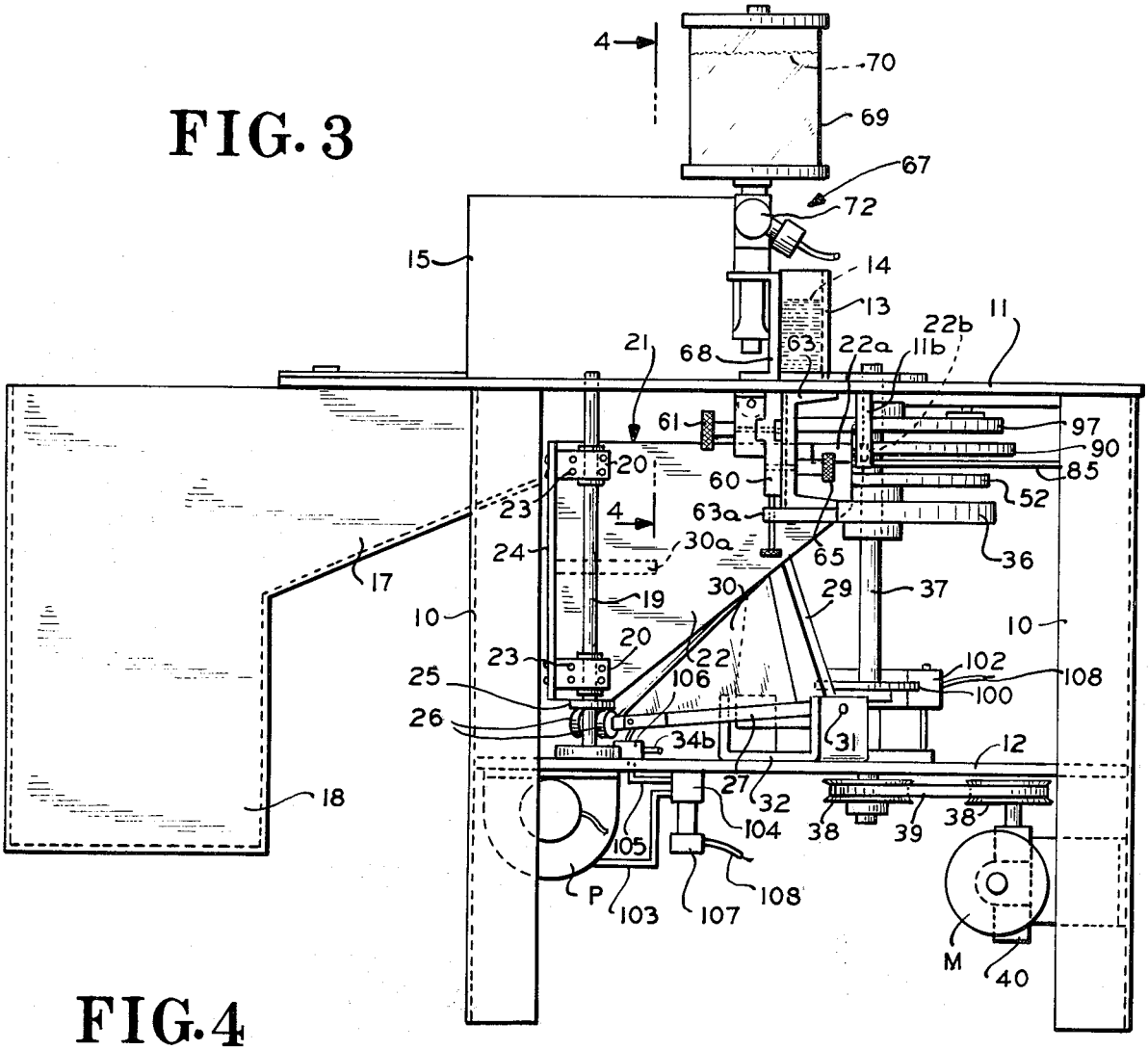
FIG. 3 is a rear elevational view of the machine.
Figure 6:
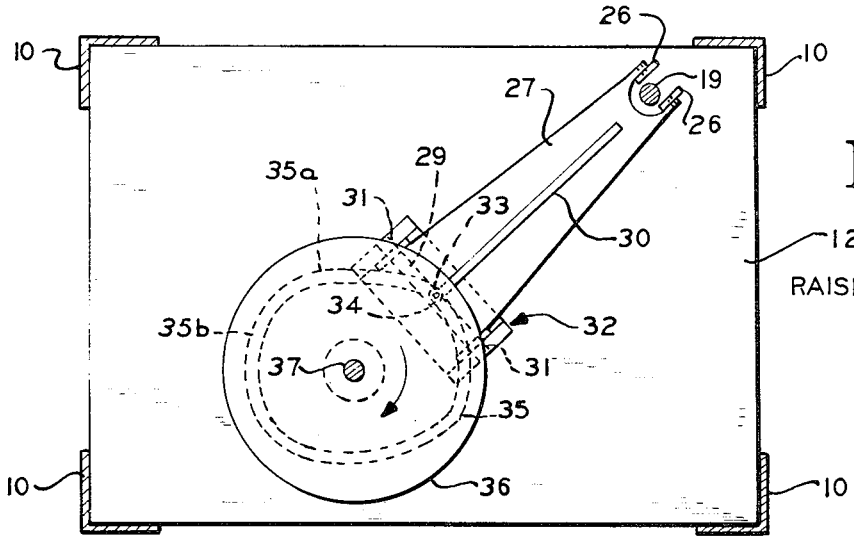
FIG. 6 is a sectional view on the line 6—6 of FIG. 2.

The main carriage 21 is weight-biased through a collar 25 onto a pair of rollers 26 journalled to a fork-shaped arm 27 (FIGS. 2 and 6) which embraces the rod 19. The arm 27 constitutes the bottom member of a rocker 28 having a vertical V-shaped plate 29 (FIGS. 2 and 3) secured rigidly to the arm 27 through a triangular gusset 30 welded therebetween. The plate 29 has trunnions 31 at the opposite ends which are journalled in apertured side members of a U-bracket 32 mounted on the shelf 12. Secured to the top of the plate 29 is a vertically extending pin 33 (FIG. 6) receiving a roller 34 which engages a non-circular groove 35 in the bottom face of a cam disk 36. This cam disk is secured to a vertical shaft 37 journalled at its ends in the table 11 and shelf 12. The shaft is coupled below the shelf through pulleys 38 and a belt 39 to a gear reduction 40 driven by a motor M mounted on one of the legs 10 (FIG. 3). By reference to FIGS. 6 and 12A, at the start position of the cam disk 36 the roller 34 registers with a point in the cam groove 35 at a maximum radial distance from the shaft 37 to tilt the rocker 28 downwardly and place the main carriage 21 in its lowermost position. As the cam plate 35 is turned clockwise through one revolution completing one stamp-mounting cycle of the machine, the main carriage 21 is raised and lowered during the first 105° movement of the cam disk, is retained in nearly its lowermost position during a next approximately 65° movement, is again raised and lowered during a next 120° movement, and is retained in its lowermost position during the remaining 70° movement.

Figure 7:
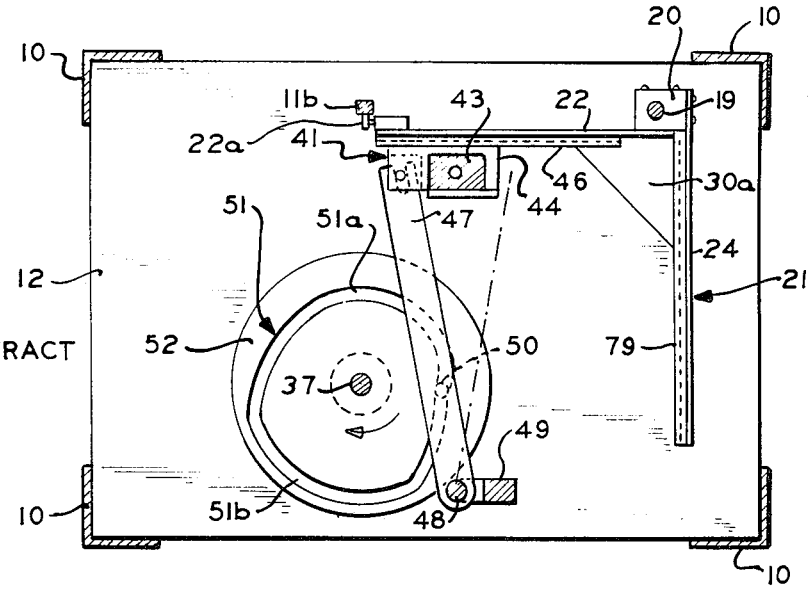
FIG. 7 is a section on the line 7—7 of FIG. 2.
Figure 9:
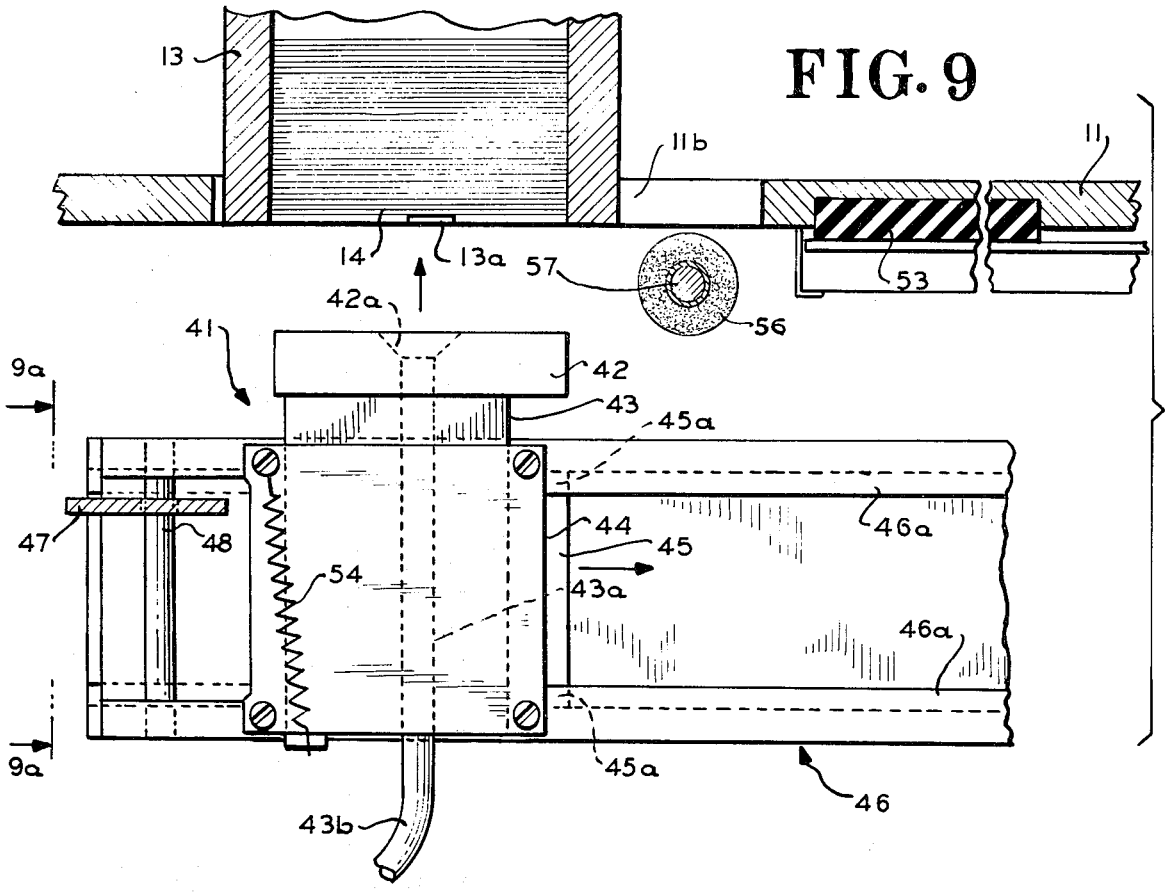
FIG. 9 is a vertical section to enlarged scale on the line 9—9 of FIG. 1.
Figure 9A:
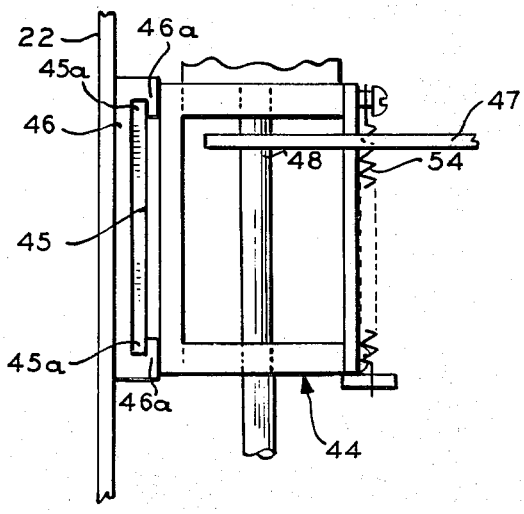
FIG. 9A is a fractional sectional view on the line 9*a*—9*a* of FIG. 9.
Figure 12:
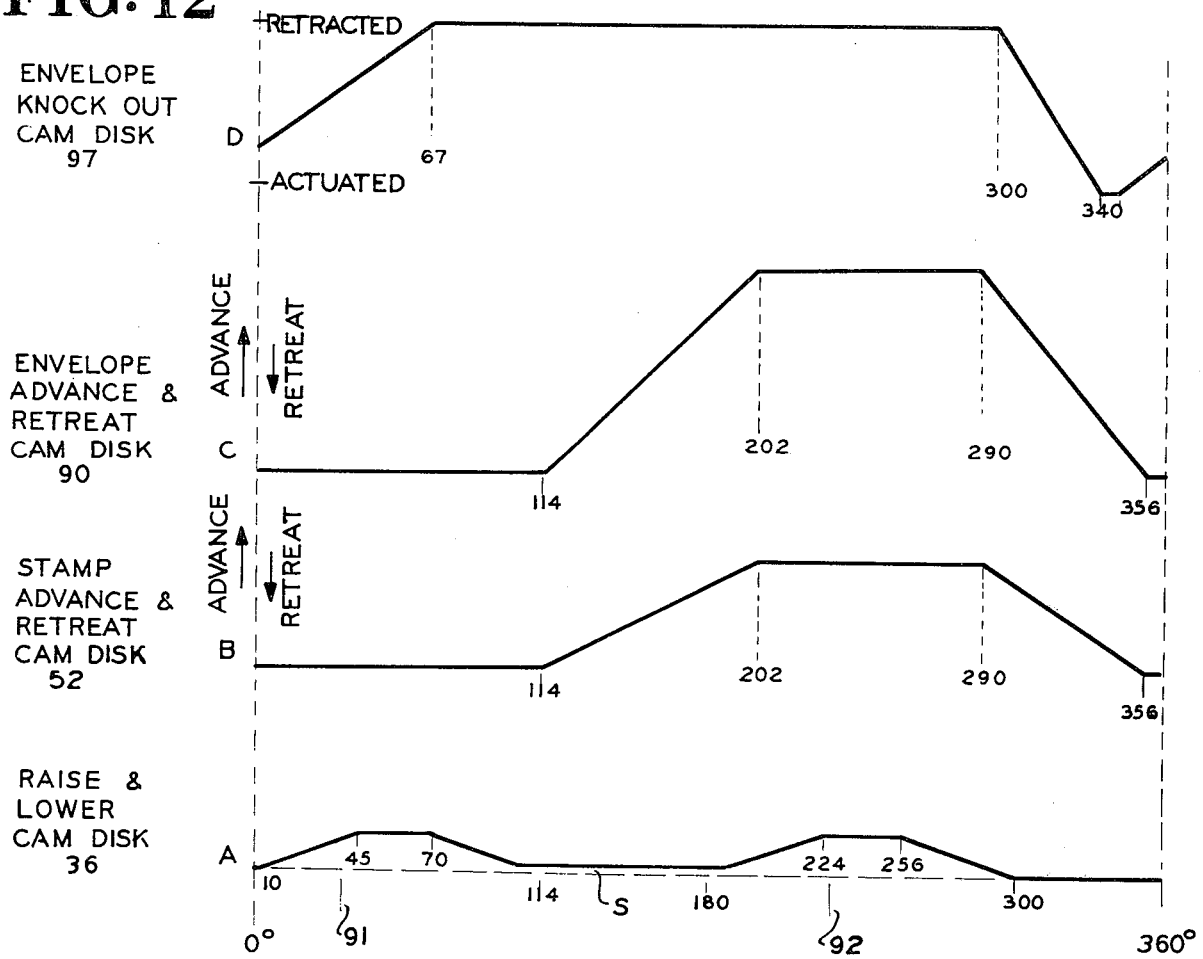
FIG. 12 is a series of graphs showing the timing between the different operations of the machine.

Mounted on the inner wall of the upper portion of the rear side plate 22 of the main carriage 21 is a vacuum grip device 41 (FIG. 9) for picking off the bottom stamp 14 from the magazine 13. This grip device 41 comprises a stamp pad 42 mounted on the upper end of a rectangular plunger 43 which slides vertically in slotted side members of a U-shaped carriage 44 (FIGS. 7 and 9A) closed at its right end (FIG. 9). This plunger has a central duct 43*a* connected at the bottom via a tube 43*b* to a vacuum pump P (FIG. 2) and has a flared opening 42*a* at the top forming a suction cup. The carriage 44 is mounted on a horizontal slide plate 45 having undercut edges 45*a* engaging a horizontal track 46 secured to the plate 22, the track having overhanging top and bottom edges 46*a* which embrace the edges 45*a*. The carriage 44 is shifted horizontally along the side plate 22 by a front-to-back extending rocker arm 47 (FIGS. 7 and 9) having a forked end engaging a pin 48 bridging the side members of the carriage 44 and pivoted at its forward end to a bracket 49 depending from the table 11 (FIG. 2). The rocker arm has a roller 50 thereon which engages a cam groove 51 in the upper face of a cam disk 52 secured to the shaft 37 directly above the cam disk 36. In the start position of the cam disk shown in FIG. 7, the roller 50 engages a dwell portion 51*a* of the groove at the smallest radial distance from the shaft 37, causing the vacuum stamp pad to be at the left end of its travel directly below the stamp magazine 13. In the first approximately 105° rotation of the cam disk 52, the pin traverses the dwell portion 51*a* of the groove 51 leaving the stamp pad 42 at standstill below the stamp magazine (FIG. 12B). However, during this portion of the cycle the main carriage 21 is first raised, to bring the stamp pad 42 against the bottom of the stack of stamps 14 in the magazine 13 and to pick off the lowermost stamp by vacuum applied to the stamp pad. Next, the stamp pad 42 is lowered to carry the stamp to a level below the envelope to which the stamp is to be applied, as will appear. In the continuing clockwise rotation of the cam disk 52 through approximately 90°, the pin 50 engages a radially outwardly progressing portion of the groove 51, causing the stamp pad 42 to be shifted to the right to a stamping station below a backing pad 53 on the under side of the table 11 (FIGS. 1 and 9). By reference to FIG. 12B, this rightward travel of the stamp pad 42 occurs while the main carriage 21 is in its nearly lowermost position, but as the stamp pad reaches its rightmost position the main carriage is being raised, causing it to reach its fully raised position about 20° later as shown by reference to FIG. 12A. It is during this raising of the main carriage that the stamp pad 42 is pressed against an envelope backed by the pad 53 by pressure of a tension spring 54 between the plunger 43 and carriage 46 (FIG. 9) biasing the plunger 43 upwardly relative to the carriage. During the applying of a stamp to an envelope and during an ensuing lowering of the main carriage to disengage the stamp pad 42 from a stamped envelope, the stamp pad 42 is retained at its right end of travel by the pin 50 then engaging a dwell portion 51*b* of the cam 51. As the main carriage 21 nears its lowermost position, the pin 50 traverses an inwardly extending portion of the groove to shift the stamp pad back to its start position.

Figure 10:
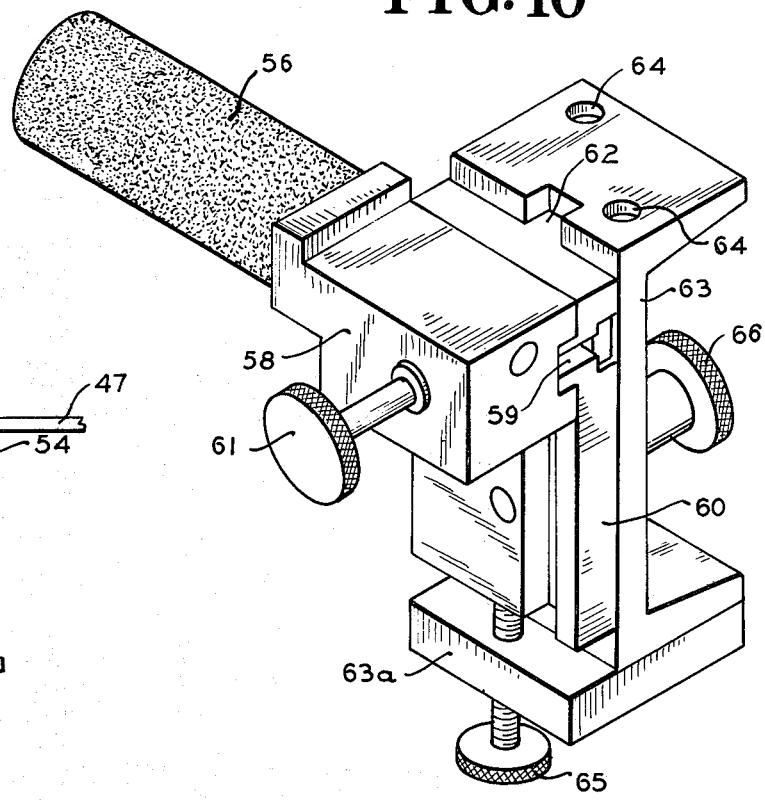
FIG. 10 is a perspective view of a roller for moistening the stamps individually and of its adjustable mounting.

As a stamp is being carried by the pad 42 from a point below the magazine 13 to a point below the pad 53, the main carriage is slightly above its lowermost position (FIG. 12A) causing the stamp to be swept in contact past a moistening roller 56 along a bottom tangential line thereof (FIGS. 1, 9 and 10). This roller is preferably of a felt composition and is journalled on a shaft 57 secured rigidly at its rear end to an adjustable block 58. The block 58 is shiftable horizontally in directions axially of the roller on a track 59 of a second block 60, and is secured in its adjusted position relative to the latter by a clamping screw 61. The block 60 is adjustable vertically on a t rack 62 of a bracket 63 secured to the under side of the table 11 by screws engaging screw holes 64 in the bracket, the vertical adjustment being by a thumb screw 65 in a bottom flange 63*a* of the bracket. The block 60 is retained in its adjusted position by a clamping screw 66 in the depending wall of the bracket. These adjustments in the positioning of the moistening roller are critical in order that the stamp will receive an adequate amount of moisture as it is moved past the roller but will not be displaced or wrinkled in any way during its passage under the roller.

Figure 4:
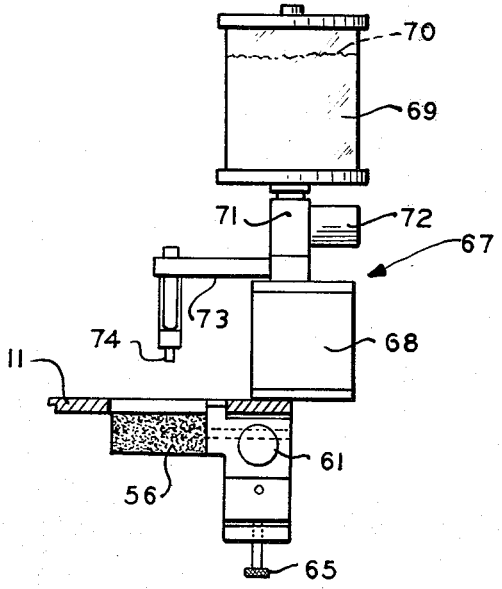
FIG. 4 is a fractional sectional view on the line 4—4 of FIG. 3.

A moistening of the roller 56 is maintained at a controlled rate by a dropper 67 mounted via a bracket 68 above the table 11 (FIGS. 3 and 4). This dropper comprises a flask 69 containing a supply of water 70. The flask feeds down through a needle valve 71 electrically controlled by a solenoid 72 to open the valve only when the motor M is turned on. The water so released feeds through a tube 73 and down to a dropper nozzle 74 onto the roller through an opening 11*b* in the table 11 (FIG. 9).

Mounted on the inner wall of the upper portion of the right side 24 of the main carriage 21 is a second vacuum gripper device 75 having a vacuum envelope pad 80 directly below the magazine 15 for picking off the bottom envelope 16 from this magazine. The envelope pad is mounted above a horizontal plate 76 supported via a bracket 77 from a slide plate 78 having undercut edges 78*a* (FIG. 2). The slide plate engages a horizontal track 79 on the side wall 24 having overhanging edges 79*a* embracing the slide plate to guide the envelope pad 80 for front and back travel along the plate 24. The envelope pad 80 is guided vertically on headed studs 81 upstanding from the plate 76 and is spring-biased upwardly by three compression springs 82. The envelope pad is provided with two suction cups 83 (FIG. 1) coupled by tubing 84 to the vacuum pump P. As the main carriage 21 is raised, the envelope pad 80 is pressed yieldably through the compression springs 82 to engage the bottom envelope in the magazine with a vacuum grip, and when the carriage is next lowered the lowermost envelope is drawn off past the detent lugs 15*a* to a level below the table. As is shown in FIG. 1, the envelope pad 80 has a cutout 80*a* to expose a rear corner portion of the envelope from the bottom for application of a stamp thereto by the stamp pad 42 hereinbefore described.

Figure 8:
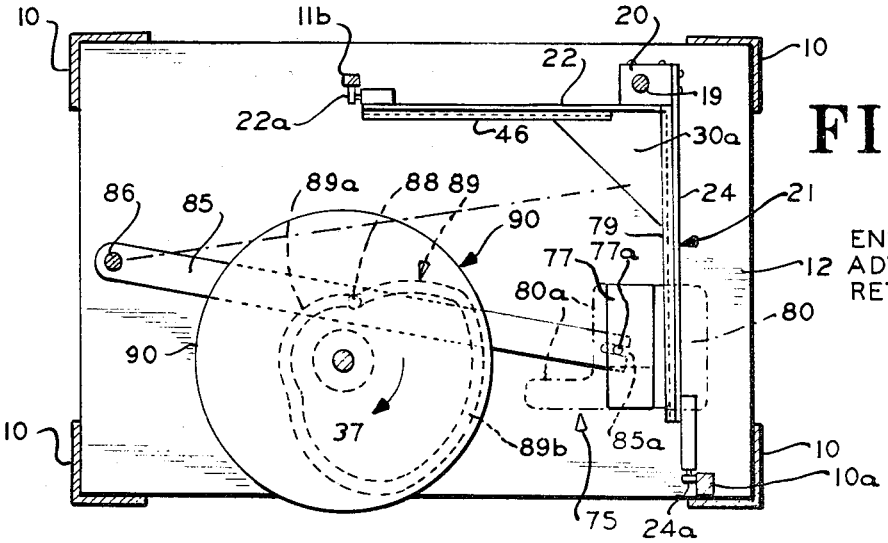
FIG. 8 is a section on the line 8—8 of FIG. 2.

The envelope pad 80 is shifted from front to back by a horizontal lever 85 extending laterally of the machine (FIGS. 2 and 8). This lever is pivoted at its left end to a stud 86 depending from the table 11, and has a forked right end portion 85*a* slidably engaging a vertical pin 77*a* on the bracket 77. While the main carriage is being raised and lowered by rotation of the cam disk 36 from its start position shown in FIG. 6, the envelope pad 80 is held against travel by a roller 88 on the lever 85 engaging a dwell portion 89*a* of a cam groove 89 in the bottom face of a cam disk 90 secured to the shaft 37 above the cam disk 52 (FIGS. 2 and 8). Thereupon, as the main carriage is retained in its lowermost position, the roller 88 starts traversing the remaining portion of the groove 89 extending radially outwardly from the shaft 37 to swing the lever 85 first to shift the envelope pad 80 rearwardly to carry the envelope by vacuum grip to the stamping station — which shifting movement may be started before the stamp pad is fully lowered by reason of a slant-off clearance 16*a* provided below the rear springs 15*a* shown in FIG. 11 —, then to retain the envelope at the stamping station as the roller 88 traverses an outer dwell portion 89*b* of the groove, and thereupon to release the vacuum grip and return the envelope pad forwardly to its start position. However, by reference to the graphs 12A and 12C, the main carriage 21 is raised and lowered while the envelope pad 80 is retained at the stamping station to hold the envelope clamped against the pad 53, and further by reference to graph 12B it is seen that the stamp pad 42 is raised during this same time to cause the stamp carried thereby to be pressed against the exposed corner portion of the envelope.

As shown by the dotted outline of an envelope in FIG. 1, the envelope overhangs the left side of the pad 80. At the left side of the envelope magazine there is a ledge 15*b* which is at a level below this overhanging portion of the envelope when the pad is in its lowermost position (FIGS. 1, 2 and 11). The purpose of this ledge is to support the overhanging portion of the envelope against drooping down to any excessive extent. This ledge has an even extension past the back side of the envelope magazine formed by an angle iron 15*d* (FIGS. 1 and 11) having a turned-down lug at its forward end secured to the back end of the ledge 15*b* and secured as by screws at its back end to a bar 15*e* which serves as a backstop to the envelope when the envelope reaches its stamp-mounting position. This bar is secured by screws 15*g* to the underside of the table 11. The left inside wall of the stamp magazine and the upright side of the angle iron 15*d* form a guide to prevent lateral displacement of the envelope as it is being carried by the pad 80 to the stamp-mounting position, and the extension of the bar or backstop 15*e* to the right of the stamp-mounting position forms a guide for the envelope as it is knocked from the envelope pad 80 into the receptacle 18.

Figure 5:
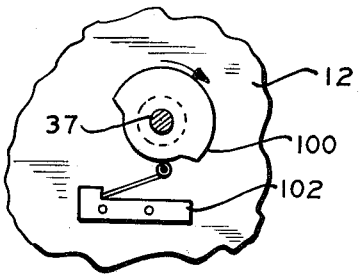
FIG. 5 is a fractional sectional view on the line 5—5 of FIG. 2.

The vacuum pump P is connected by tubing 103, valve 104 and tubing 105 to a manifold 106 (FIG. 2). Leading from this manifold is the tubing 84 to the envelope pad 80 and the tubing 43*b* to the stamp pad 42. The valve 104 is controlled by a solenoid 107 connected by a cable 108 to a switch 102 operated by a cam 100 on the shaft 37 (FIG. 5). This cam is shaped to control the solenoid 107 so that the vacuum is applied to the stamp pad 42 and to the envelope pad 80 when the main carriage is first raised to its uppermost position during a cycle of the machine, as at approximately a point 91 about 30° from the start position of the cycle (FIG. 12A). This vacuum is later cut off in the same cycle of the machine when the main carriage is again raised to its uppermost position, as at approximately a point 92 about 224° along the time axis. Thus, when the main carriage starts being lowered after cut-off of the vacuum, the vacuum grip to both the applied stamp and to the envelope is released, leaving the stamped envelope lying free on the pad 80 solely by its own weight. As the main carriage nears its lowermost position, the slide 46 for the stamp pad 42 and the slide 78 for the envelope pad 80 begin their travel back to their start positions with the stamp pad now clearing the moistening roller as indicated by the clearance S in FIG. 12A.

At approximately the instant the slides 46 and 78 begin their return movement (FIGS. 12B and 12C), an envelope knockout slide member 93 mounted on the underside of the table 11 (FIGS. 1 and 11) is moved in a rightward direction (FIG. 12D) through a clearance opening D in the channel guide member 15*d* (FIG. 11) against the left rearward corner portion of the envelope overhanging the cutout 80*a* of the envelope pad 80 to push the envelope through the chute 17 into the receptacle 18. This knockout member 93 has an L-shaped end face 93*a* (FIG. 2) so that it supports the envelope vertically at its point of engagement during the knockout operation. The knockout member 93 is moved by a horizontal lever 95 having a pin-slot coupling at one end to the knockout member and pivoted at the other end to a post 96 depending from the table 11 (FIGS. 1 and 2). An intermediate portion of the lever overlies a cam disk 97 also secured to the shaft 37. In the upper face of this cam disk is a groove 98 engaged by the pin 99 depending from the lever 95. At the start position of a cycle operation the pin is in a portion 98*a* of the groove nearest the shaft 37, at a point about 25° past that at which the knockout member is fully extended. Thus, in the immediate initial movement of the cam disk from a start position of a cycle of the machine, the knockout member is quickly further retracted and then retained in that retracted position as the pin traverses a long dwell portion 98*b* of the groove until near the end of the cycle. At the instant the stamp pad 42 and the envelope pad 80 begin their travel back to their start positions at the end of a cycle, the pin 99 enters the radially inwardly extending portion 98*a* of the groove to move the knockout member to the right and expel the stamped envelope as before described.

Upon the main carriage reaching its lowermost position and the pads 42 and 80 reaching their start positions below the stamp magazine 13 and envelope magazine 15, the cycle is completed by which a stamp has been picked off from the magazine 13, an envelope has been picked off from the magazine 15, the envelope is shifted rearwardly to a position below the pad 53, the stamp is shifted to the right across the moistening roller to a position below the corner portion of the envelope underlying the pad 53, and the main carriage is raised to press the stamp against the corner portion of the envelope backed by the pad 53. All of these operations are accomplished in a precisely timed sequence to apply the stamp on the envelope at an exact position on the envelope without distorting or marring the stamp or envelope in any way and, further, these operations are carried out in a rapid and economical manner.

The embodiment of my invention herein particularly shown and described is intended to be illustrative and not necessarily limitative of my invention since the same is subject to changes and modifications without departure from the scope of my invention which I endeavor to express according to the following claims.

I claim:

1. A machine for automatically applying stamps to envelopes comprising respective magazines for said stamps and envelopes mounted in parallel arrangement, respective vacuum pads for picking off said stamps and envelopes one by one from the same ends of said respective magazines, a main carriage for said vacuum pads mounted for back and forth shifting movement in the directions of said magazines, means yieldably mounting said pads on said main carriage for independent movement relative to the carriage in directions of said shifting movement, means mounting said respective pads on said carriage for traveling movement at right angles to the carriage movement to and from a stamping station whereat a stamp from the stamp magazine is placed in overlapping relation to an envelope from the envelope magazine, and power means cyclically operable for imparting a first reciprocation to said main carriage towards and from said magazines to cause said pads to pick off a stamp and an envelope from the respective magazines, to impart then a traveling movement to each of said pads to said stamping station, and to impart next a second reciprocation to said carriage in the directions of said shifting movement to cause said stamp to be pressed against said envelope.

2. The machine set forth in claim 1 wherein the corner portions of said stamp magazine are cut away to provide clearance for the corner serrations of said stamps.

3. The machine set forth in claim 1 including a backing member for said envelope at said stamping station, and wherein said power means includes means for causing said vacuum pads to be pressed yieldably against said magazines during said first reciprocation of said main carriage of each cycle of said power means, and means for causing said envelope to be pressed yieldably against said backing member and said stamp to be thereupon pressed yieldably against said envelope backed by said backing member during said second reciprocation of said main carriage of each cycle of said power means.

4. The machine set forth in claim 3 wherein both of said magazines are positioned at a level above said pads, and said yieldable mounting is directed to press said pads relative to the main carriage in directions towards said respective magazines, and wherein said mounting means for said pads are adapted to place said stamp pad at a lower level than said envelope pad whereby when said pads are moved to said stamping station said stamp pad is below said envelope pad and the envelope pad is below said backing member to cause the envelope to be pressed first against the backing member and then the stamp to be pressed against the envelope as said main carriage is raised during its second reciprocation in a cycle of said power means.

5. The machine set forth in claim 4 including knockout means for removing a stamped envelope from said envelope pad, wherein said power means comprises a motordriven shaft, and a series of cams on said shaft respectively operative during each revolution of said shaft for shifting said main carriage through said first and second reciprocations, shifting said stamp pad on said main carriage back and forth between said stamp magazine and said stamping station, shifting said envelope pad on said main carriage back and forth between said envelope magazine and said stamping station, controlling said vacuum source, and actuating said knockout means when a stamped envelope has been released from said vacuum member.

6. The machine set forth in claim 4 wherein the envelope pad is terminated short of supporting the envelope at the end thereof to which a stamp is to be applied leaving this end portion of the envelope overhanging the pad, including a side wall below said envelope magazine in line with the side wall of the magazine engaging the edge of said end portion of the envelope and extending from said magazine to the far side of said stamp-mounting station for guiding said edge of the envelope during the travel of the envelope to said station, and a narrow ledge on said side wall extending from said envelope magazine to said station for supporting said overhanging portion of the envelope against excessive drooping during said travel.

7. The machine set forth in claim 6 including a guide wall at the far side of said stamp-mounting station for providing a backstop for the leading side edge of the envelope to locate the envelope at an exact point of advance in the forward travel thereof to said station.

8. The machine set forth in claim 7 including a chute and a knockout ram traversing a clearance opening in said side wall at said station for knocking an envelope after a stamp is applied thereto through said chute, wherein said backstop wall is extended from said station to said chute to guide the envelope as it is being pushed off said envelope pad.

* * * * *